United States Patent [19]

Blackmer

[11] Patent Number: 4,938,161

[45] Date of Patent: Jul. 3, 1990

[54] HOIST APPARATUS FOR A SAILBOARD RIG

[76] Inventor: Richard Blackmer, 109 Oakwood Dr., Scotia, N.Y. 12302

[21] Appl. No.: 276,003

[22] Filed: Nov. 25, 1988

[51] Int. Cl.[5] ..... B63B 35/00

[52] U.S. Cl. ..... 114/39.2; 114/91

[58] Field of Search ..... 114/39.1, 39.2, 90, 114/91, 97, 102

[56] References Cited

U.S. PATENT DOCUMENTS 4,498,411 2/1985 Marker ..... 114/97

FOREIGN PATENT DOCUMENTS 3327227 2/1984 Fed. Rep. of Germany ..... 114/39.2
3248589 7/1984 Fed. Rep. of Germany ..... 114/39.2
2575720 7/1986 France ..... 114/39.2

*Primary Examiner*—Joseph F. Peters, Jr.
*Assistant Examiner*—Jesus D. Sotelo
*Attorney, Agent, or Firm*—William C. Crutcher

[57] ABSTRACT

An improved hoisting apparatus for a sailboard rig of the type which is attached to a sailboard with a universal connection, the improved hoisting apparatus comprising a hoist pole with a bottom end and a top end, an attachment connecting the bottom end of the hoist pole to the mast to provide pivotable and rotational movement of the hoist pole with respect to the mast, a halyard including first and second tension members extending from the top end of the hoist pole, the first tension member connected to the boomhead, the second tension member having a graspable end portion for exerting a force on the hoist pole to hoist the rig, and elastic cord members connected to return the hoisting apparatus to a stowage position when the graspable end portion is released. A third tension member connects the bottom end of the hoist pole to the boomhead so as to transfer the axial force component on the hoist pole caused by hoisting forces to the boomhead, thereby requiring the bottom end attachment to sustain only transverse force components. In one embodiment, the first and second tension members are furnished by a single uphaul passing freely through a guide ring in the top end of the hoist pole.

12 Claims, 6 Drawing Sheets

HOIST APPARATUS FOR A SAILBOARD RIG

BACKGROUND OF THE INVENTION

This invention relates generally to sailboards and more particularly to apparatus for hoisting the rig of the sailboard before getting underway.

In order to start a sailboard when wind conditions or the sailor's lack of skill prevent using the wind to lift sail or sailor out of the water, the sailor must stand on the sailboard and hoist the mast, boom, and sail (collectively known as the "rig") out of the water and into sailing position. The hoisting is normally accomplished with an "uphaul" attached to the mast end of the wishbone boom. The uphaul is a braided or knotted grip line that hangs between the boomhead and sailboard deck, frequently secured at its free end with an elastic tether cord. Hoisting force on the uphaul can exceed 200 pounds with large sails, even in a moderate breeze, because wind forces on the sail and sailboard cause the sail to lie flat just below the water surface. To start a hoist under these conditions, the sailor must first apply significant force to dump water out of the sail. The required force then increases as the wind drags the clew of the sail through the water. This can be a serious problem with large sail rigs when a sailor is off shore and winds suddenly increase.

Because of rig and sailboard geometry, uphaul tension has to be transmitted with back muscles and is subject to twisting from wave motion and sail instability in high wind. Leaning back to use legs more effectively, reduces uphaul lever arm and, consequently, increases the required uphaul tension. In U.S. Pat. No. 4,498,411 issued to Marker on Feb. 12, 1985 the rig hoisting problem is addressed with a boom extension that pivots in the plane of the sail from a stowage position against the mast above the boomhead. An uphaul attached to the end of the boom extension twists the sail into a vertical position in the water and then provides leverage to hoist the sail rig towards a vertical position in the air. Since Marker's boom extension pivots only in one plane, the Marker hoist apparatus does not provide any mechanical advantage when the sail is lying flat on or below the water surface and becomes unstable in high wind in the transition from hoist to sailing position. In shallow water, the Marker hoisting apparatus must force the boom tail against the bottom as the sailor attempts to turn the boom to a right angle position to the water surface before pulling the sail rig out of the water. This can damage the boom tail or trail an upleasant mess from the bottom.

Any hoisting apparatus which is used to substitute for the normal uphaul should have means for automatically retracting it as the sailor gets underway, since it cannot interfere with the board sailing and there is very little time to accomplish stowage of the apparatus.

Accordingly, one object of the present invention is to provide an improved hoisting apparatus for a sailboard rig.

Another object is to provide a improved uPhaul for a sailboard which reduces strain on the sailor'back during the first stages of hoisting the rig.

Still another object of the invention is to provide improved hoisting apparatus with automatic stowage of the apparatus after the sailing rig is hoisted.

SUMMARY OF THE INVENTION

Briefly stated, the invention comprises an improved hoisting apparatus for a sailboard rig of the type which is attached to a sailboard with a universal connection, the rig comprising a mast, boom and sail, said improved hoisting apparatus comprising a hoist pole with a bottom end and a top end, attachment means adapted to connect the bottom end of the hoist pole to the rig to provide pivotable and rotational movement of the hoist pole with respect to the mast, halyard means including first and second tension members extending from the top end of the hoist pole, the first tension member being adapted for connection to the rig at a point distal from the sailboard with respect to the attachment means to permit pivoting of the hoist pole on the attachment means away from the mast to a selected angle, the second tension member having a graspable end portion for exerting a force on the hoist pole to hoist the rig when the hoist pole is so pivoted, and retracting means including elastic cord members connected to return said hoisting apparatus to a stowage position when the graspable end portion is released. In a preferred embodiment, a third tension member connects the bottom end of the hoist pole to the rig, preferably to the boomhead so as to transfer the axial force component on the hoist pole caused by hoisting forces to the boomhead, thereby requiring the attachment means to sustain only transverse force components. In another embodiment, the first and second tension members are furnished by a single uphaul passing freely through a guide ring in the top end of the hoist pole. In another embodiment, the first tension member is attached near the top of the mast and a second tension member is provided by an extender line connected to the normal uphaul.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

FIG. 1 is a perspective view of a sailboard with the rig in the water prior to hoisting, illustrating a simplified form of the invention, FIG. 2 is an enlarged perspective view, partly in section, illustrating a preferred form of the invention providing refinements of the FIG. 1 simplified version, FIG. 3 and 4 are perspective views of a modified form of my invention, FIG. 3 illustrating the hoisting apparatus with rig partially raised and FIG. 4 illustrating the sailboard with hoisting apparatus stowed when underway, FIG. 5 is a perspective view of yet another modification of the invention with the hoisting apparatus attached to the rig and hoist pivoted, FIG. 6 is a perspective view of the hoisting apparatus of FIG. 5 detached from the rig and with hoist pole retracted to a stowage condition, and FIG. 7 is an enlarged perspective view showing a modification of the FIG. 5 embodiment.

DESCRIPTION OF THE PREFERRED EMBODIMENT

Figure 1:
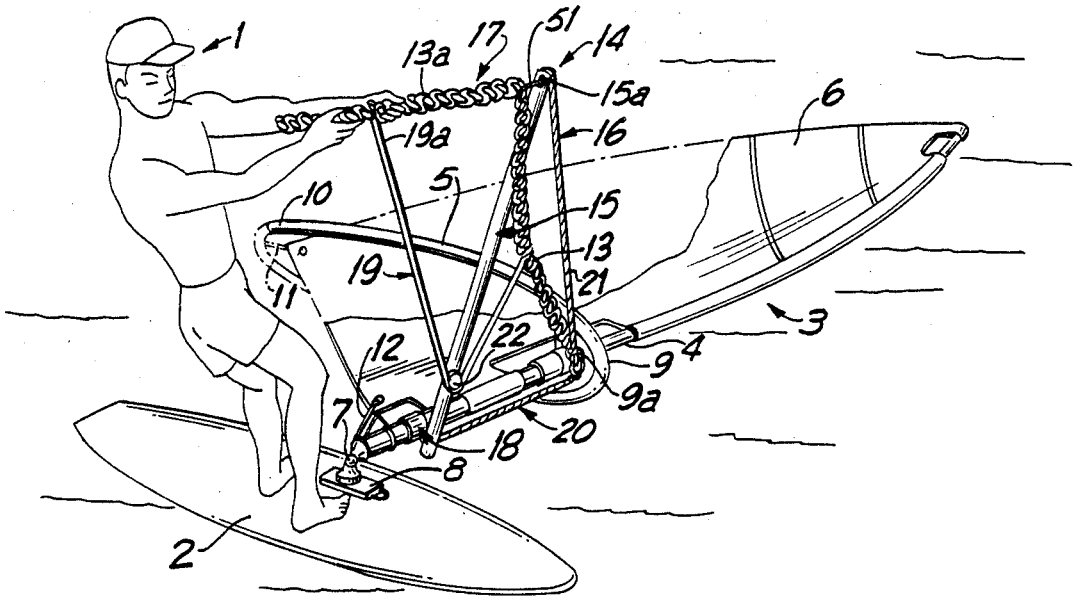

Referring now to FIG. 1 of the drawing, illustrating a simplified form of the first embodiment of the invention, a sailor 1 is standing on a sailboard 2 of a conventional and well-known type with a rig 3 in the water preparatory to hoisting and getting underway. The rig 3 collectively comprises a mast 4, a wishbone boom 5 connected to an intermediate location on mast 4 and a sail 6. Rig 3 is connectable to the sailboard 2 through the mast by means of a universal joint 7 which may be attached to a mast step 8 on sailboard 2 in a known manner. The boom 5 is rigidly secured to the mast 4 by lashing a boomhead 9 to the mast and is bifurcated to terminate in a boom tail 10. The sail 6 is rigged and made taut between the boom and the mast by means of an outhaul 11 secured between the clew of the sail and boom tail 10, and a downhaul 12 secured between the tack of the sail and the end of the mast adjacent the universal joint 7. The conventional means of hoisting rig 3 would include an uphaul 13, which is also part of rig 3, consisting of a braided or knotted sheet or halyard attached at one end to boomhead 9 and graspable at the other end by sailor 1. The foregoing elements comprise a conventional sailboard and rig and form no part of the present invention.

In accordance with the present invention, a hoisting apparatus shown generally as 14 includes a hoist pole 15, halyard means comprising a first tension member 16 and a second tension member 17, attachment means 18 for pivotably and rotatably connecting the lower end of hoist pole 15 to the mast and retracting means including an elastic cord 19. A third tension member 20 is employed in a preferred embodiment of the invention and is connected between boomhead 9 and the bottom end of hoist pole 15 in order to transfer the axial component of force on hoist pole 15 to boomhead 9 so that the attachment means 18 need only sustain a force component transverse to mast 4.

Referring to further details of the components of hoisting apparatus 14, the first tension member 16 comprises a section of a hoisting line 21 extending from the top end of hoist pole 15 and retractable into the top end of hoist pole 15 which is hollow in this case. Line 21 is adapted for connection to the rig at a point distal from the sailboard (with respect to attachment 18), in this case by tying to boomhead 9 using hole 9*a* in the boomhead.

The second tension member 17 extends from the top end of the hoist pole 15 toward the sailor. Tension member 17 is made up of a tie line 51 and a section designated 13*a* of uphaul 13. Uphaul section 13*a* and tie line 51 are connected by a knot or clip. Section 13*a* terminates in a graspable end portion held by sailor 1. Tension members 16, 17 together comprise halyard means for hoisting the rig 3.

The attachment means 18 may be of any suitable type which permits pivoting movement of the top end of hoist pole 15 to a selected angle with respect to mast 4 as shown. The selected angle is preferably around 45 degrees to the horizontal, although this may vary between 30 degrees and 60 degrees. In addition, attachment 18 is arranged to permit rotation of the angled hoist pole with respect to the mast axis, i.e. out of the plane of the sail into a substantially vertically plane.

The retraction means 19 in the simple form shown in FIG. 1 consists of the elastic cord 19*a* secured between intermediate locations on uphaul 13 and passing over a block 22 near the bottom end of hoist pole 15. The hoist pole 15 is pivoted to a selected angle as shown by pulling the hoist pole up with the second tension member (uphaul section 13*a* and tie line 51). The hoisting line 21 runs out of the top end of the hoist pole through a hole (described later in connection with FIG. 2) by stretching an elastic retractor cord inside the hoist pole until a stop limits the pivot edge. Additional tension applied by the sailor is substantially equal in the first and second tension members 16, 17 and provides an axial compressive force component to the hoist pole.

The hoisting apparatus 14 of FIG. 1 is deployed by pivoting hoist pole 15 applying tension to the uphaul until it is in position shown in FIG. 1, this being facilitated by the pivotable and rotatable attachment 18 to allow the hoisting apparatus to swing out of the substantially horizontal plane of the sail into a vertical plane. As the rig 3 is hoisted with additional tension the force transmitted along hoist pole 15 may be considered as divided into axial and transverse components with respect to the mast. The axial force component tending to slide the attachment 18 toward the mast universal 7 is transferred to the third tension member 20 and thence to the boomhead. The transverse force component is sustained by attachment 18.

Figure 2:
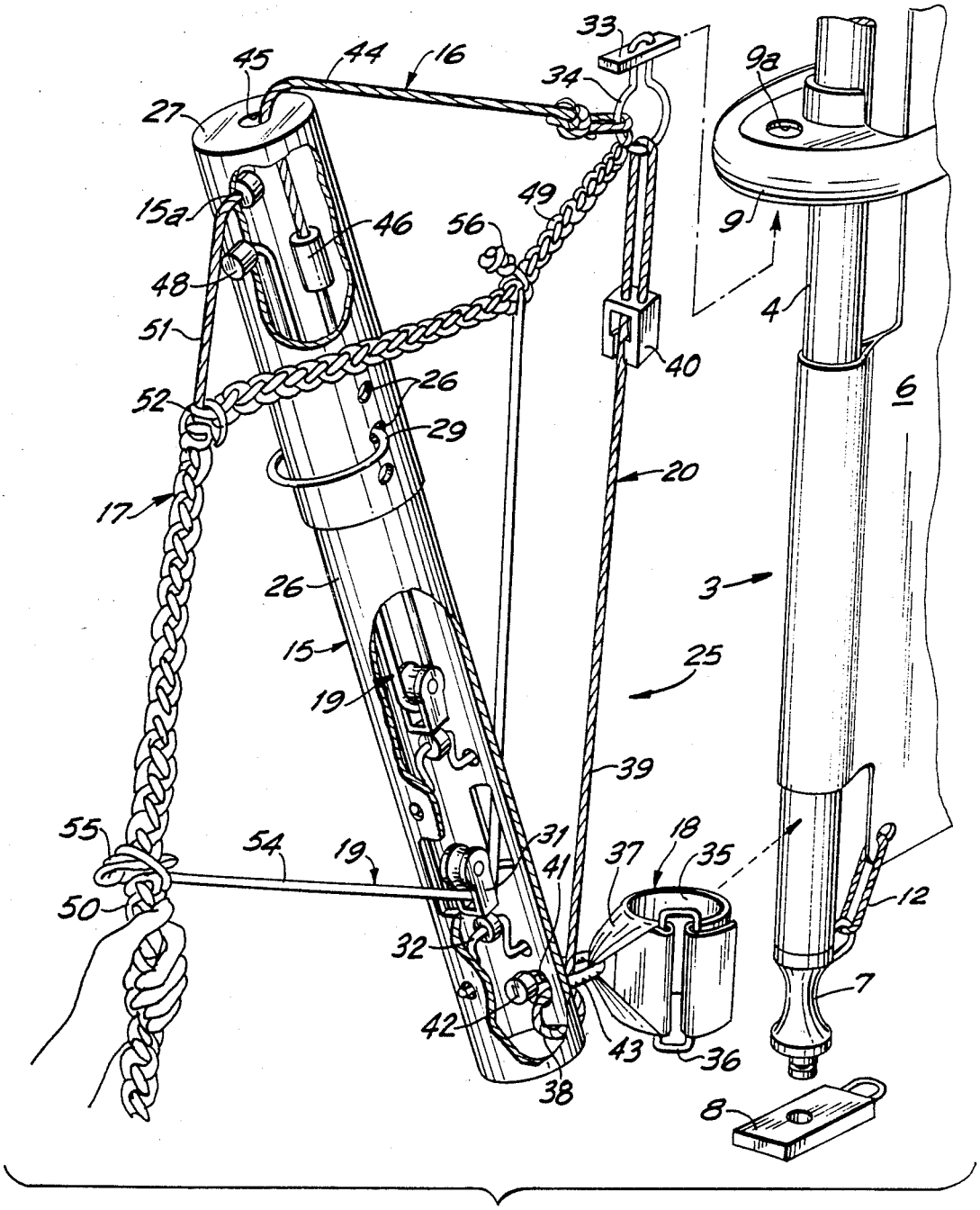

Reference to FIG. 2 of the drawing illustrates a retraction means inside the hollow hoist pole which may be used for the first tension member 16 shown in FIG. 1. Elements which are the same as previously described in connection FIG. 1 are designated with the same reference numerals. The conventional elements of the rig 3 are shown to the right, while the hoisting apparatus detached from the rig 3 is shown on the left and indicated generally by reference numeral 25. The major elements of the hoisting apparatus 25, but shown in modified form include the hoist pole 15, first tension member 16, second tension member 17, attachment means 18, retraction means 19. Also included is a third tension member 20.

In FIG. 2, hoist pole 15 comprises a hollow tube 26 with a cap 27 and a series of adjustment holes 28 with a securing spanner ring 29. Mounted inside tube 26 is a take-up block 30 and a retraction cord block 31. These are secured within the tube by U-shaped pins 32. Blocks 30, 31 could also be combined in a single two pulley block. The first and third tension members 16, 20 are attached to rig 3 distal from the sailboard by connecting them to boomhead 9 by means of a toggle 33 or other suitable quick connector suitably adapted for boomhead 9 and including a tie loop 34.

At the lower end of the hoisting apparatus near the sailboard, the hoist pole 15 and third tension member 20 are connected to the rig by attachment means 18, which includes a quick connecting strap 35 designed to go around the mast and attached by buckle 36 or Velcro TM straps. A loop 37 attached to the strap 35 is connected to the bottom end of tube 26 by a knot 38. The knot is made in the lower end of a line 39 serving as the third tension member 20. The upper end of line 39 passes through tie loop 34 and is attached to itself by means of a taut line cleat or taut line hitch 40. Cleat 40 permits adjustment of the length of third tension member to allow for varying distances between boomhead 9 and mast step 8. The knot 38 is secured to the bottom end of hoist pole 15 by looping through a hole 41 and is secured by an anchor block 42. A bight 43 in the knot and loop 37 provide a loose connection which allows the pivoted hoist pole to rotate with respect to the mast axis, as well as to allow the hoist pole to pivot with respect to the mast to a selected angle for hoisting the rig.

First tension member 16 extends from top end of the hoist pole to the boom head 9 and is retractable into the hoist pole tube 26. It comprises a hoist line 44 knotted to the tie loop 34 at one end and entering a hole 45 in cap 27 at the top end of hoist pole 15, terminating in a connector block 46 which determines the selected pivot angle of the hoist pole. Part of the retracting means 19 includes an elastic cord 47 connected to block 46 which passes through the pulley of take-up block 30 and is anchored to the cap at 48. A conventional uphaul 49 of a braided or knotted rope is connected at one end to tie loop 34 and terminates in a graspable end portion 50. A tie line 51 is attached to uphaul 49 by a knot 52 and is anchored to the top end of the hoist pole at its other end by passing through a hole 15*a* in the cap. Tie line 51 and the section of uphaul 49 between knot 52 and the sailor together comprise the second tension member 17.

Another part of the retracting means 19 consists of an elastic cord 54 knotted to uphaul 49 at 55, 56 and passing through retraction cord block 31. Cord 54 serves a retracting means for the uphaul 49 when it is released. The elastic cord 47 serves as retracting means for the second tension member (line 44) by pulling it into the tube 26 and also as retracting means returning the hoist pole to a non-pivoted stowage position parallel to the mast.

The sailor deploys the hoisting apparatus of FIG. 2 by grasping portion 50 of the uphaul 49 and pulling the hoist pole by means of tie line 51 until hoist line 44 is fully extended (approximately 70 percent of hoist pole length). At a selected angle of approximately 45 degrees determined by connector block 46, the hoist pole 15 is ready to hoist the rig from the water.

It is important to note that the third tension member simplifies the construction of attachment means 18. Forces exerted on the bottom end of the hoist pole during hoisting are resolved into a force vector axial to the mast and a force vector transverse to the mast. The force component axial to the mast is transferred by the third tension member 20 to boomhead 9, so that the attachment 18 only sustains forces transverse to the mast at its point of attachment. This allows a lighter and simpler construction of the connector strap 35.

When the rig is clear of the water, grasping the uphaul 49 on the side of knot 52 toward the rig releases the tension members 16, 17, permitting the retracting means (cords 54 and 47) to automatically stow the hoist pole parallel to the mast and pull the uphaul 49 and line 44 into a neat stowage position.

Figure 3:
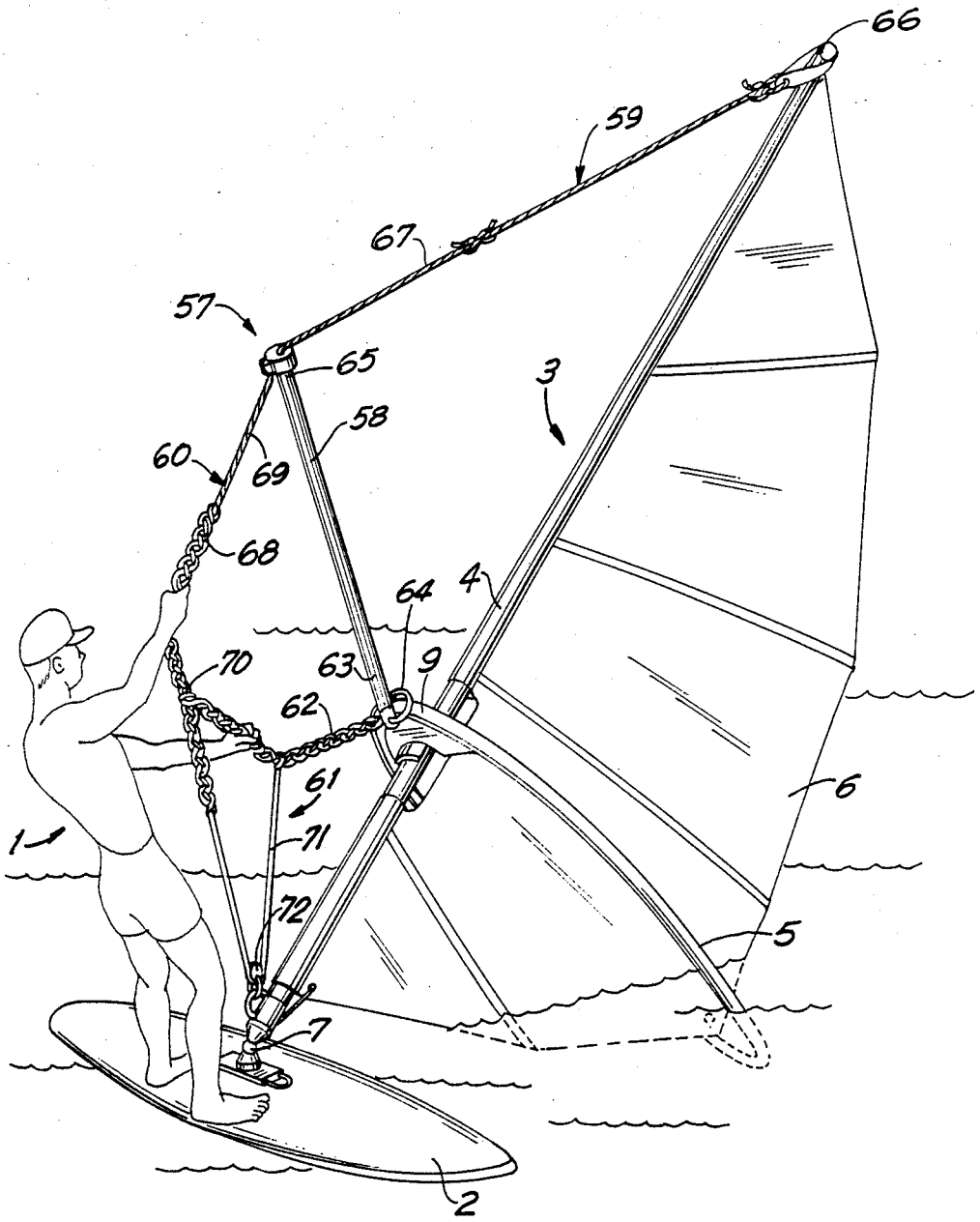
Figure 4:
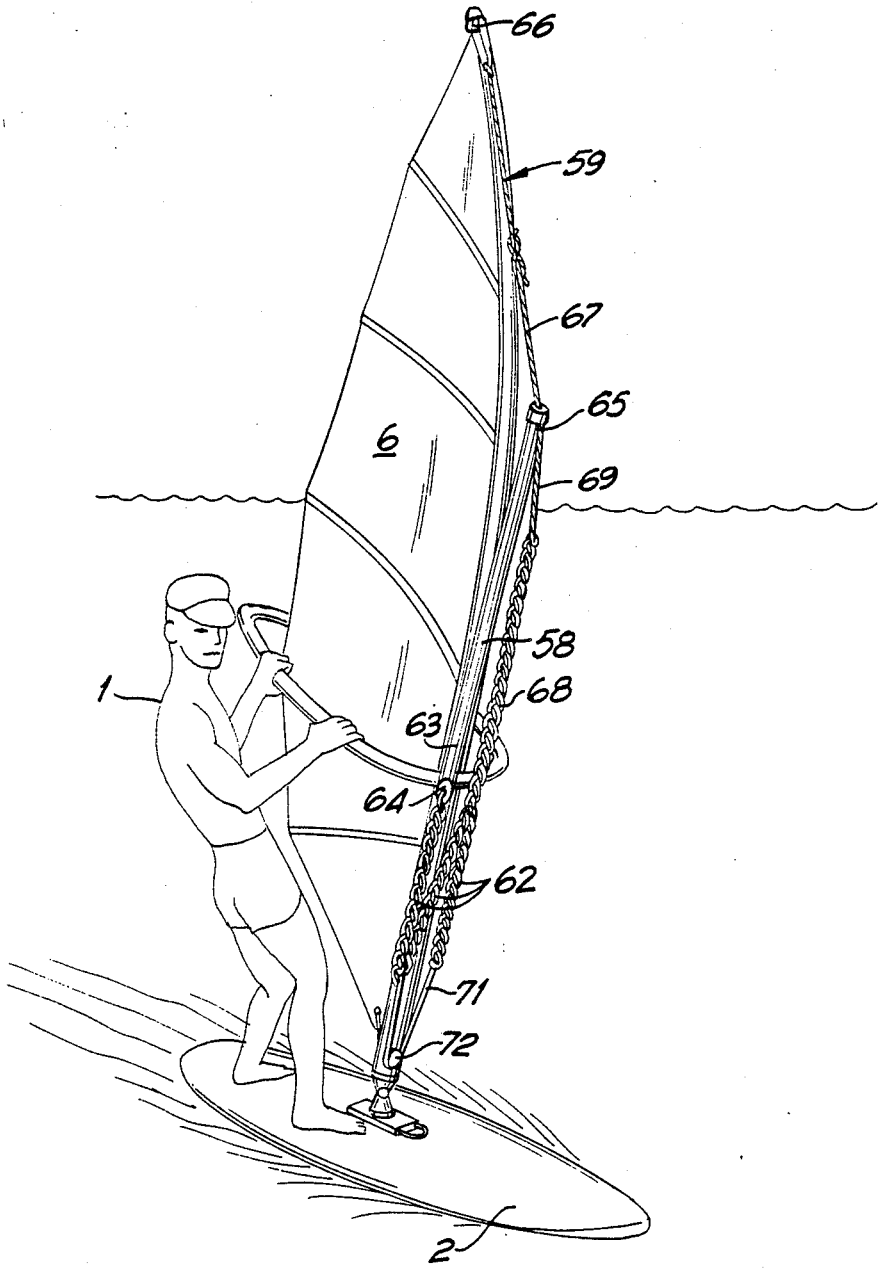

Referring now to FIGS. 3 and 4 of the drawing, a modified form of the invention shows a hoisting apparatus generally at 57 comprising a hoist pole 58, halyard means including a first tension member 59, a second tension member 60, and retracting means 61. Hoisting rig 57 is adapted for connection to the rig 3, which includes a conventional uphaul 62. In accordance with the present invention, the bottom end 63 of hoist pole 58 is adapted for connection to the rig at the boomhead 9 by means of a simple knotted tie looP or snap ring 64 which permits limited rotation of the pivoted hoist pole 58 with respect to the mast axis, and also allows it to pivot away from the axis to a selected angle shown in FIG. 3. The first tension member 59 extends from the top end 65 of hoist pole 58 to a point distal from the sailboard here the masthead 66 with respect to the attachment 64 on boomhead 9. First tension member 59 includes a lift line 67 which is selected from a material which is elastic but has a limiting stretched length as shown in FIG 3.

The second tension member 60 comprises a line 69 extending from the top end of the hoist pole and including a graspable end portion 68 which is knotted to uphaul 62 at 70. The retracting means 61 comprises an elastic cord 71 which is knotted at opposite ends to a mid point and to the free end of the uphaul 62 and passes over a block 72 attached to the mast near the rig universal connector 7.

The operation of the FIG. 3 embodiment is illustrated in FIGS. 3 and 4. In FIG. 3, the sailor grasps and pulls the end portion 68 of the halyard means and the connection 64 allows the pivoted hoist pole 58 to rotate with respect to the mast axis as the rig is hoisted. Hoist pole 58 is pivoted away from the stowage position parallel to the mast to a selected angle as permitted by the limited elasticity of line 67. Force exerted on the first and second tension members 59, 60 is transmitted through hoist pole 58 to the boomhead 9 through the attachment means.

When the rig is clear of the water, the sailor releases halyard end portion 68 and grasps the conventional uphaul 62. At this point, as shown in FIG. 4, the retracting means consisting of the elastic cord 71 and the elastic lines 67 retract the hoist pole 58 and the uphaul 62 and other lines against the mast.

Figure 5:
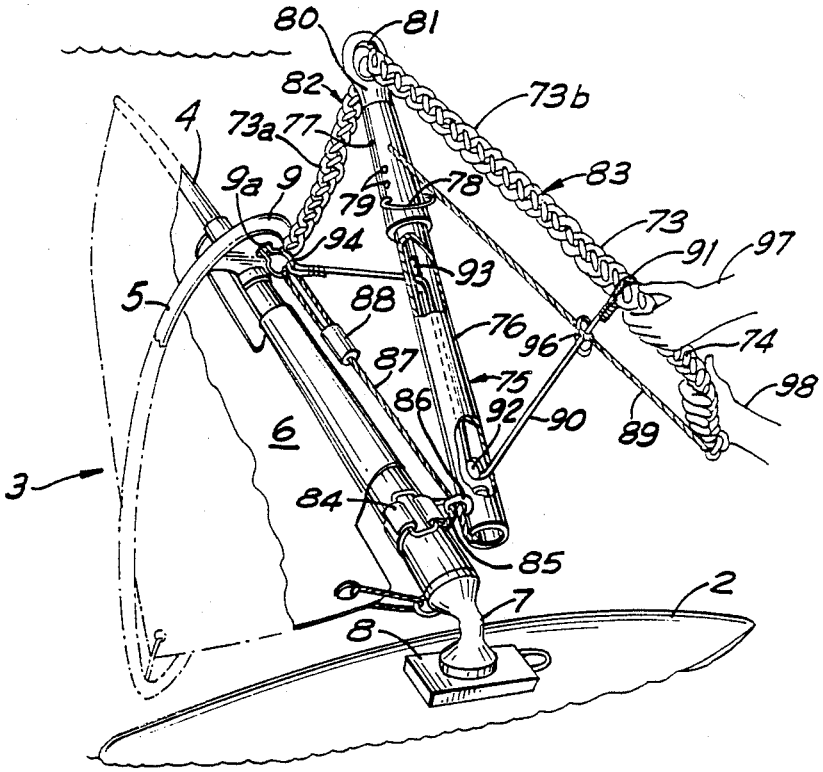
Figure 6:
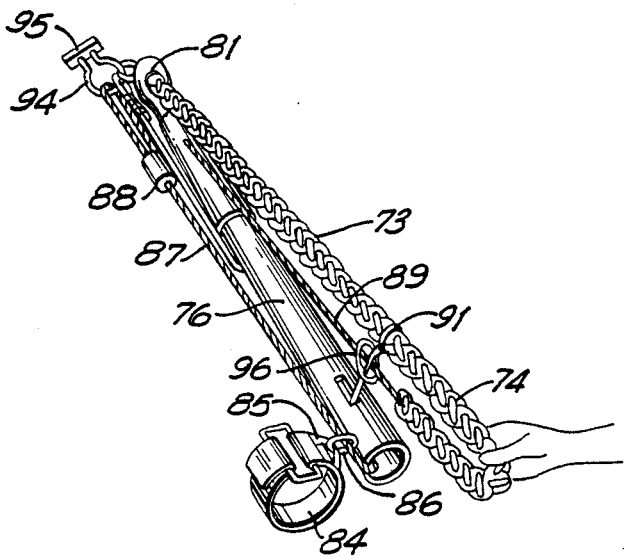

FIGS. 5 and 6 illustrate yet another modification of the invention. The rig 3, consisting of mast 4, boom 5, and sail 6, is shown attached to sailboard 2 through universal 7 at step 8 as before. A braided uphaul 73 is connected to boomhead 9 by tying through a hole 9*a* in the conventional manner and terminates in a graspable end portion 74.

In accordance with the present invention, a hoist pole 75 including a tube 76 and a cap 77 which provides an adjustment in length by means of spanner pin 78 and adjustment holes 79 has a top end 80 with an eye or guide ring 81. Uphaul 73 passes through the guide ring. The section of uphaul 73 designated 73*a* between the guide ring and the boomhead comprises a first tension member 82 and a section 73*b* of uphaul 73 between the guide ring and the graspable end portion 74 comprises a second tension member 83. In this case, instead of the first and second tension members being separately connected to the top end of the hoist pole, they are part of the same member 73.

The bottom end of hoist pole 75 is connected to the mast by attachment means which provide for pivotable and rotational movement with respect to the mast axis as before. The attachment means includes a buckle (or Velcro TM) strap connector 84 with tie loop 85 and portions of a knot 86 which may be formed as previously described in connection with FIG. 2. The knot 86 may conveniently comprise the lower end of a line 87 with length adjustment provided by a taut cleat 88 as previously described in connection with FIG. 2, and serving as a third tension member to transfer axial force component exerted by the hoist pole to the boomhead.

An erector line 89 is connected between the top of the hoist pole and the free end of the uphaul 73. Retraction means include an elastic cord 90 connected to the uphaul at 91, passing over a block 92, through a hole 93, and attached to a tie loop 94. The block 92 and hole 93 are spaced along the hoist pole and act as guides for the cord 90 to urge the hoist pole toward a non-pivoted position. Erector line 89 and cord 90 are collected by a ring 96, as the hoisting apparatus is retracted to a stowage position.

Reference to FIG. 6 shows the hoisting apparatus when detached from rig 3 and in retracted position. The attachment means 84 is easily adapted for connection to the rig by looping around the mast 4 near the sailboard. The tie loop 94 is provided with a quick connect toggle 95 which is easily adapted for quick connection to the rig at a location distal from the sailboard (with respect to the attachment means 84) by attachment to the boomhead 9, although it could also be connected to the mast through a separate strap or clamp connector. The length adjustment both of the hoist pole itself and of the third tension member with cleat 88 permit the hoisting apparatus to be used on sailboards of varying types and suitable for boom adjustments of varying height in any one rig.

In operation, the FIG. 5 and 6 modification is deployed by grasping the end of the uphaul 73 with one hand on the graspable end portion 74 without creating tension on the uphaul. The other hand 98 then is used to pull erector line 89 to rotate the hoist pole 75 into a vertical plane and to pivot the hoist pole away from the mast to a selected angle. At this point, tension is applied by pulling on the uphaul 73, whereupon the two sections 73*a*, 73*b* of uphaul 73 assume the role of first and second tension members 82 and 83. Since the tension in both sections is equal, frictional engagement of the uphaul in the guide ring 81 locks the hoist pole 75 at the selected angle. As the hoist effort brings the rig and mast 4 to approximately 45 degrees with the water surface, hoist pole 75 is now substantially vertical near the sailor. At this point, the sailor can allow the hoist pole to retract by lifting the uphaul 73 slightly so that the elastic cords of the retracting means return hoist pole 75 to the stored position beneath the boomhead 9. When the uphaul sheet is released for sailing, elastic cord 90 pulls the hoist pole 75 by its pivot force vector at hole 93 and by pivot force vector of downward tension in the uphaul produced by the contours around the guide ring 81. The ring 96 around the intersection of the elastic cord 90 and the erector line 89 gathers the lines together as indicated in FIG. 6. The graspable end portion 74 of the uphaul is held in a neat loop without interfering with the sailor's feet and providing significant extension over a conventional uphaul length.

Figure 7:
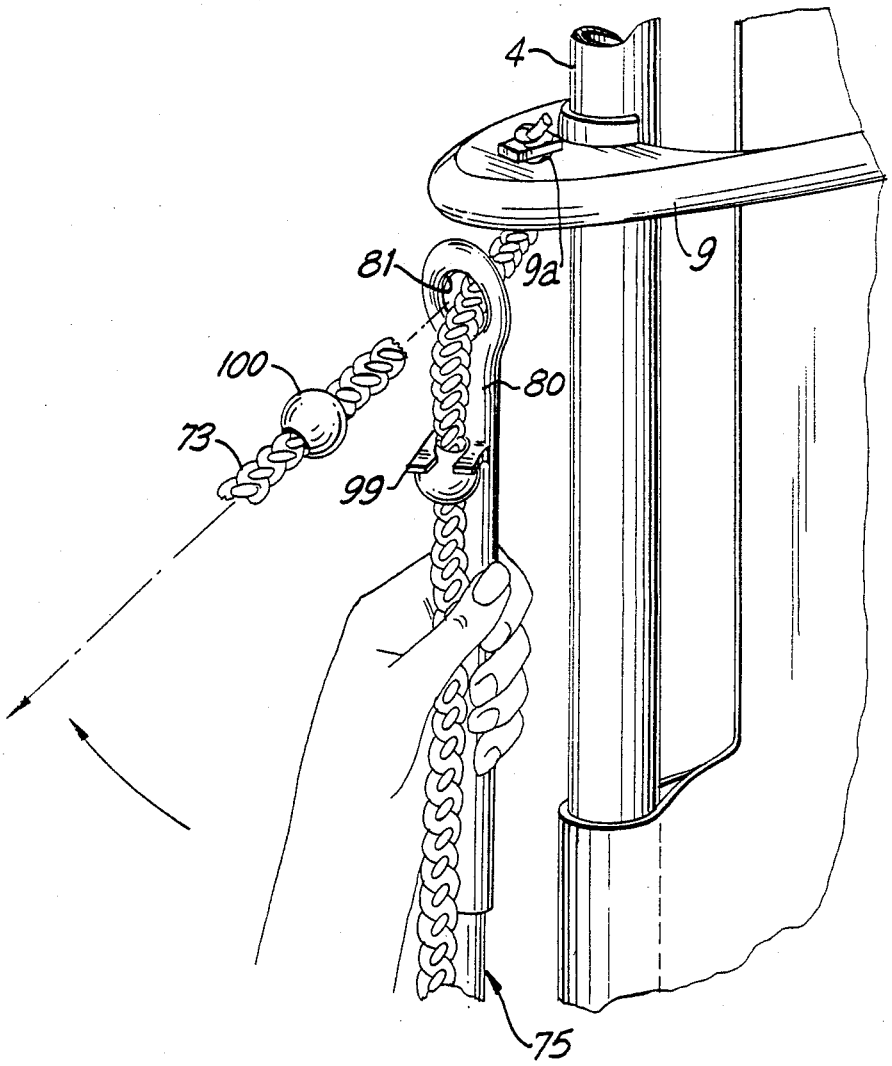

FIG. 7 shows a modification of the top end 80 of hoist pole 75 of FIGS. 5 and 6 to include means for temporarily attaching it to the rig in a non-pivoted stowage position. A transverse flange 99 placed below the guide ring 81 includes a slot wide enough for the uphaul 73. The uphaul is modified to add a ball 100 which is small enough to slip through guide ring 81, but too large to pass through the slot in flange 99. In this manner the retracted hoist pole may be temporarily attached at its top end, and since its bottom end is also attached, may be grasped by the sailor and used to manipulate the rig during tacking or other maneuvers.

Various other modifications of the invention may be imployed without departing from the scope of the invention. For example, the hoist pole, first, second, and third tension members and attachment means could provided by equivalent structures. For example, while it is contemplated that the tension members be flexible lines because of ease of attachment and stowage, rigid members could also be substituted in some cases. For example, a rigid member could be substituted for the third tension member or, as previously shown in connection with FIGS. 2 and 3, the third tension member can be eliminated altogether with the mast serving as this function. Also a pair of hinged rigid members may be substituted for the first tension member which, when extended, limit the pivot angle of the hoist pole and which may be retracted by elastic cords attached to a hinge pin between the pair of members. Various types of known attachment means may be used to allow the hoist pole to pivot and rotate with respect to the mast axis and which are adapted for quick connection to spaced locations on the rig according to the particular type of rig configuration without departing from the scope of the invention.

While there is described what is considered to be the preferred embodiment of the invention and several modifications thereof, it is intended to encompass in the appended claims all such modifications as fall within the true spirit and scope of the invention.

I claim:

1. An improved hoisting apparatus for a sailboard rig of the type which is attachable to a sailboard with a universal connection, said rig comprising a mast, a boom having a boomhead, an uphaul, and a sail, said hoisting apparatus comprising:

a hoist pole having a top end and a bottom end, attachment means adapted to connect said bottom end of said hoist pole to said rig to provide pivotable and rotational movement of the hoist pole with respect to the mast, halyard means including first and second tension members extending from the top end of the hoist pole, said first tension member adapted for connection to said rig distal from the sailboard with respect to said attachment means to permit rotating and pivoting of the hoist pole on said attachment means away from the mast to a selected angle, said second tension member having a graspable end portion for exerting a force on the hoist pole to hoist said rig when the hoist pole is so pivoted, a third tension member having one end adapted for connection to a point on said rig distal from the sailboard with respect to said attachment means and having the other end connected to said bottom end of said hoist pole, whereby said third tension member transfers the axial component of the force exerted by the bottom end of the hoist pole to said distal connection point on the rig, so that said attachment means only sustains the transverse component of force exerted by the bottom end of said hoist pole, and retracting means arranged to retract said hoisting apparatus to a stowage position when said graspable end portion is released.

2. The combination according to claim 1, wherein said hoist pole is hollow and is adapted to retract said first tension member into the interior of said hoist pole when said graspable end portion is released.

3. The combination according to claim 1, wherein said attachment means comprises a strap which is connectable around said mast, said strap being connected to the bottom end of the hoist pole by connection means.

4. The combination according to claim 3, said third tension member comprising a line connected between the boomhead and the bottom end of said hoist pole by a knot which also comprises at least part of said connection means.

5. The combination according to claim 1, wherein said retracting means comprises at least one elastic cord arranged to return said hoist pole to a non-pivoted position and to simultaneously retract at least one of said tension members.

6. An improved hoisting apparatus for a sailboard rig of the type which is attachable to a sailboard with a universal connection, said rig comprising a mast, a boom having a boomhead, an uphaul, and a sail, said hoisting apparatus comprising:

a hoist pole having a top end and a bottom end, wherein said hoist pole includes a first pulley block attached near said bottom end, attachment means adapted to connect said bottom end of said hoist pole to said rig to provide pivotable and rotational movement of the hoist pole with respect to the mast, halyard means including first and second tension members extending from the top end of the hoist pole, said first tension member adapted for connection to said rig distal from the sailboard with respect to said attachment means to permit rotating and pivoting of the hoist pole on said attachment means away from the mast to a selected angle, said second tension member having a graspable end portion for exerting a force on the hoist pole to hoist said rig when the hoist pole is so pivoted, and retracting means comprising a first elastic cord passing over said first pulley block and secured at one end thereof to said uphaul and the opposite end thereof to said rig, said retracting means arranged to retract said hoisting apparatus to a stowage position when said graspable end portion is released.

7. The combination according to claim 6, wherein said hoist pole is hollow and wherein said first tension member comprises a hoist line with a free end running inside said hoist pole terminating in a connector block limiting the pivot angle of the hoist pole and wherein said retracting means further includes a second elastic cord attached to said hoist line free end for retracting it into the hoist pole.

8. The combination according to claim 7, including a second pulley block disposed near said bottom end of the hoist pole, said second elastic cord passing over said second pulley block.

9. An improved hoisting apparatus for a sailboard rig of the type which is attachable to a sailboard with a universal connection, said rig comprising a mast, a boom having a boomhead, an uphaul, and a sail, said hoisting apparatus comprising:

a hoist pole having a top end defining a guide ring thereon, and a bottom end, and wherein said uphaul passes through said guide ring, attachment means adapted to connect said bottom end of said hoist pole to said rig to provide pivotable and rotational movement of the hoist pole with respect to the mast, halyard means including first and second tension members extending from the top end of the hoist pole, said first tension member adapted for connection to said rig distal from the sailboard with respect to said attachment means to permit rotating and pivoting of the hoist pole on said attachment means away from the mast to a selected angle, said second tension member having a graspable end portion for exerting a force on the hoist pole to hoist said rig when the hoist pole is so pivoted, said first and second tension members comprising portions of said uphaul on opposite sides of said guide ring, and retracting means arranged to retract said hoisting apparatus to a stowage position when said graspable end portion is released.

10. The combination according to claim 9, which further includes an erector line attached between the top end of the hoist pole and the uphaul for assisting in pivoting said hoist pole to a selected angle prior to placing tension on the uphaul.

11. The combination according to claim 10, wherein said retracting means comprises an elastic cord connected between the boomhead and the uphaul and passing through spaced guides along the hoist pole to cause the hoist pole to pivot to a position along the mast when the uphaul is released.

12. The combination according to claim 9, wherein the top of said hoist pole includes means for temporarily attaching it to said rig in a non-pivoted stowage position, whereby the hoist pole may be grasped and used to manipulate said rig.

* * * * *